US006113470A

United States Patent [19]

Marinack

[11] Patent Number: 6,113,470

[45] Date of Patent: Sep. 5, 2000

[54] METHOD OF FORMING A CREPING MEMBER

[75] Inventor: Robert J. Marinack, Oshkosh, Wis.

[73] Assignee: Fort James Corporation, Deerfield, Ill.

[21] Appl. No.: 09/302,288

[22] Filed: Apr. 30, 1999

Related U.S. Application Data

[62] Division of application No. 08/912,201, Aug. 18, 1997.

[51] Int. Cl.[7] ..... B24B 1/00

[52] U.S. Cl. ..... 451/45; 451/58; 451/65

[58] Field of Search ..... 451/45, 58, 65, 451/192, 193, 203, 224, 229; 29/557; 162/111

[56] References Cited

U.S. PATENT DOCUMENTS

| | | |
|---|---|---|
| 670,401 | 3/1901 | Greth . |
| 1,588,732 | 6/1926 | Hoberg . |
| 1,764,676 | 6/1930 | Campbell . |
| 2,417,210 | 3/1947 | Menzl . |
| 2,435,009 | 1/1948 | Kief . |
| 2,995,180 | 8/1961 | Klenk . |
| 3,017,317 | 1/1962 | Voightman et al. . |
| 3,163,575 | 12/1964 | Nobbe . |
| 3,476,644 | 11/1969 | Krehnbrink . |
| 3,507,745 | 4/1970 | Fuerst . |
| 4,125,659 | 11/1978 | Klowak et al. . |
| 4,185,399 | 1/1980 | Gladish . |
| 4,432,927 | 2/1984 | van Tilburg et al. . |
| 4,921,643 | 5/1990 | Walton et al. . |
| 5,906,534 | 5/1999 | Folkman et al. ..... 451/45 |

FOREIGN PATENT DOCUMENTS

| | | |
|---|---|---|
| 150549 | 2/1903 | Germany . |
| 615517 | 6/1961 | Italy . |
| 456032 | 11/1936 | United Kingdom . |

*Primary Examiner*—Timothy V. Eley
*Attorney, Agent, or Firm*—Nixon Peabody LLP; Charles M. Leedom, Jr.; Donald R. Studebaker

[57] ABSTRACT

A creping doctor blade and method of forming such blade including a thin flexible generally planar creping member having an elongated flexible, substantially prismatic body having a relieved substantially planar engagement surface adapted to bear against the drying cylinder. A rake face of the creping doctor blade extends generally outwardly relative to a surface of the rotatable drying cylinder when the creping blade engages the cylinder and the length of the substantially planar engagement surface is generally equivalent to the width of the drying cylinder with the width of the substantially planar engagement surface being selected so as to correspond to the wear pad dimension of a conventional blade used in the same processes and is generally in a range from about 0.005 inches to about 0.020 inches with the relief face of the blade adjacent to the rotatable drying cylinder having an elongated depression having a depth of at least about 0.005 inches formed therein such that as the blade wears over the majority of the life of the blade, the width of the substantially planar engagement surface remains within the range of about 0.005 inches to about 0.020 inches.

10 Claims, 8 Drawing Sheets

FIG. 6
PRIOR ART
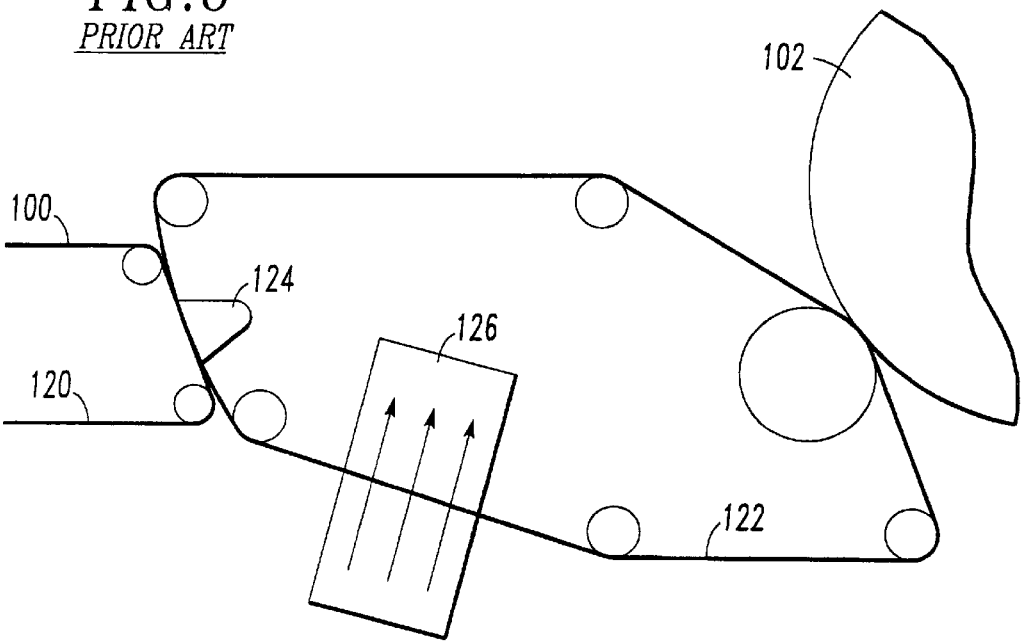
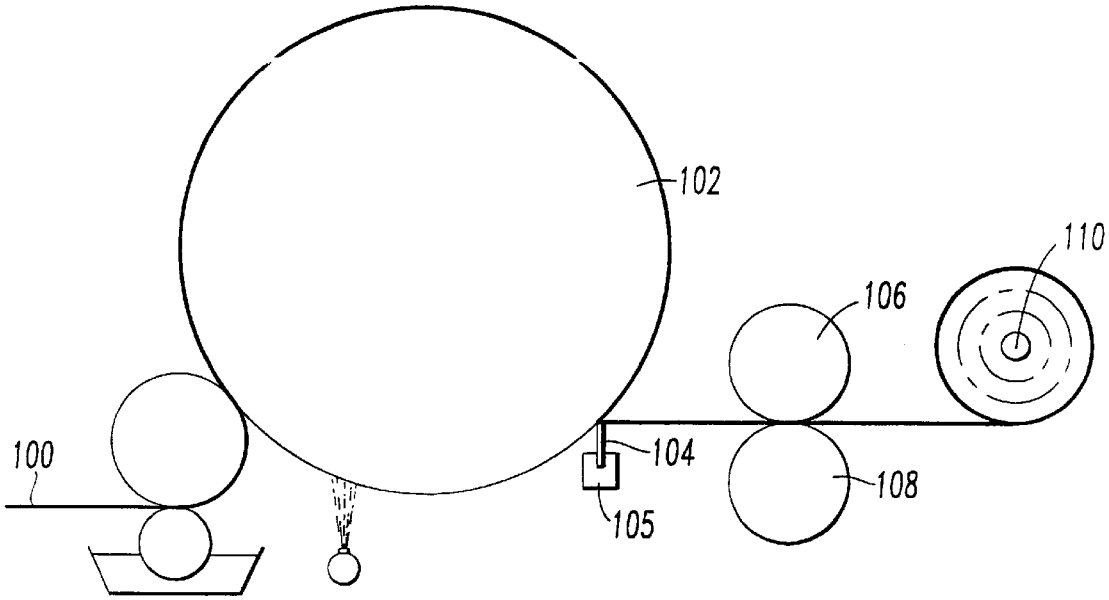
FIG. 6A

FIG. 7
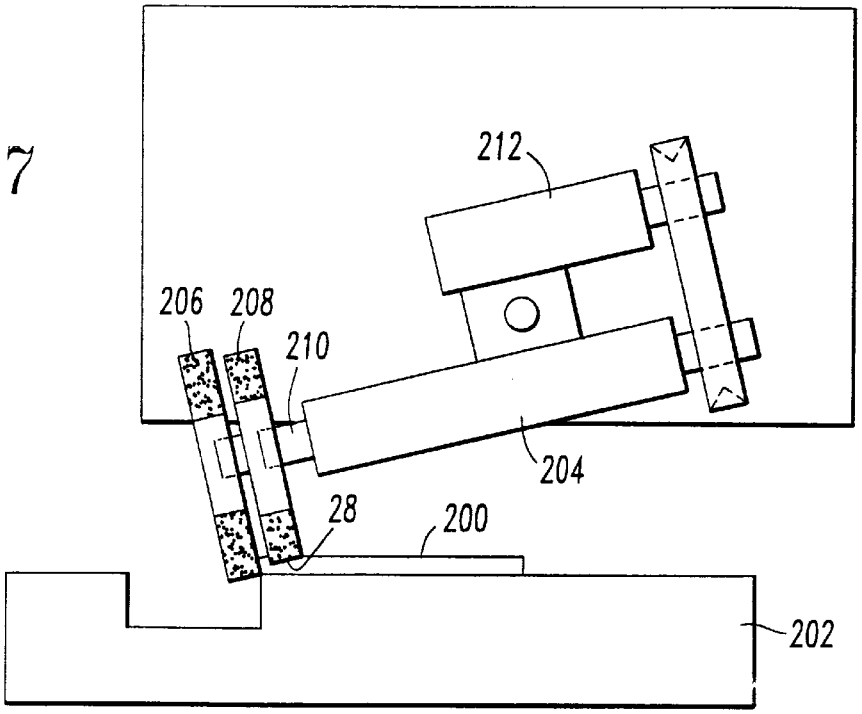
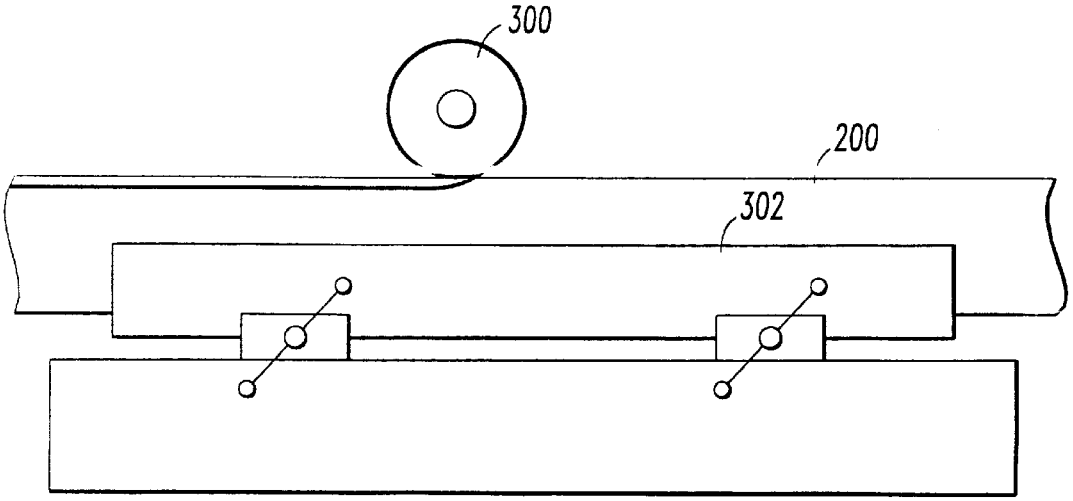
FIG. 8

FIG. 13
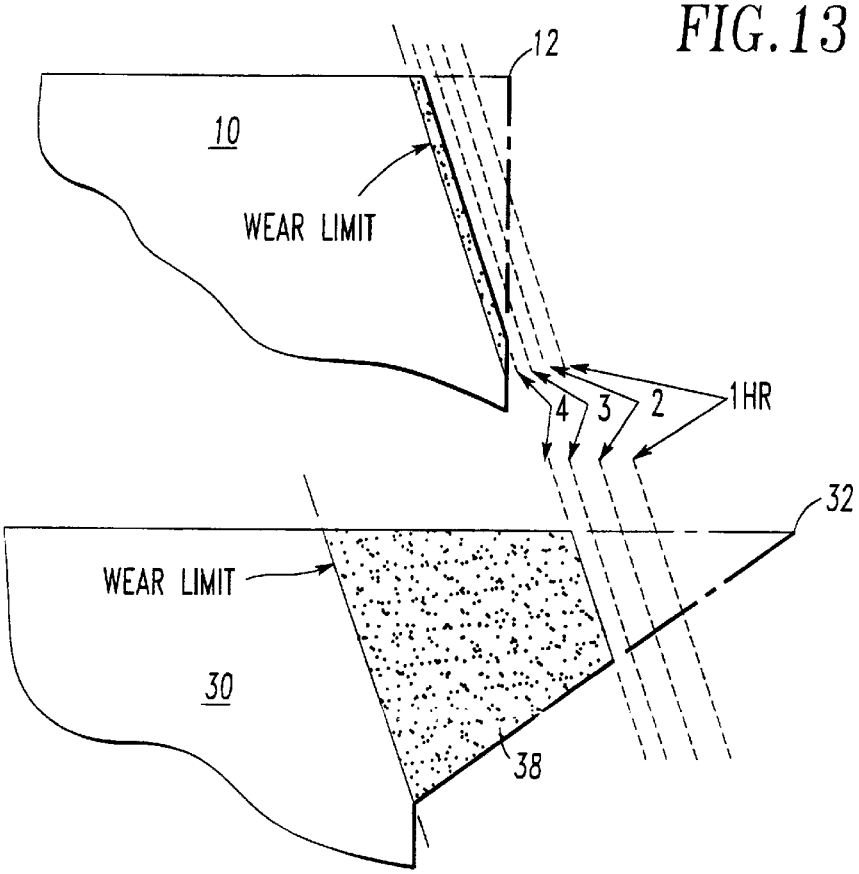
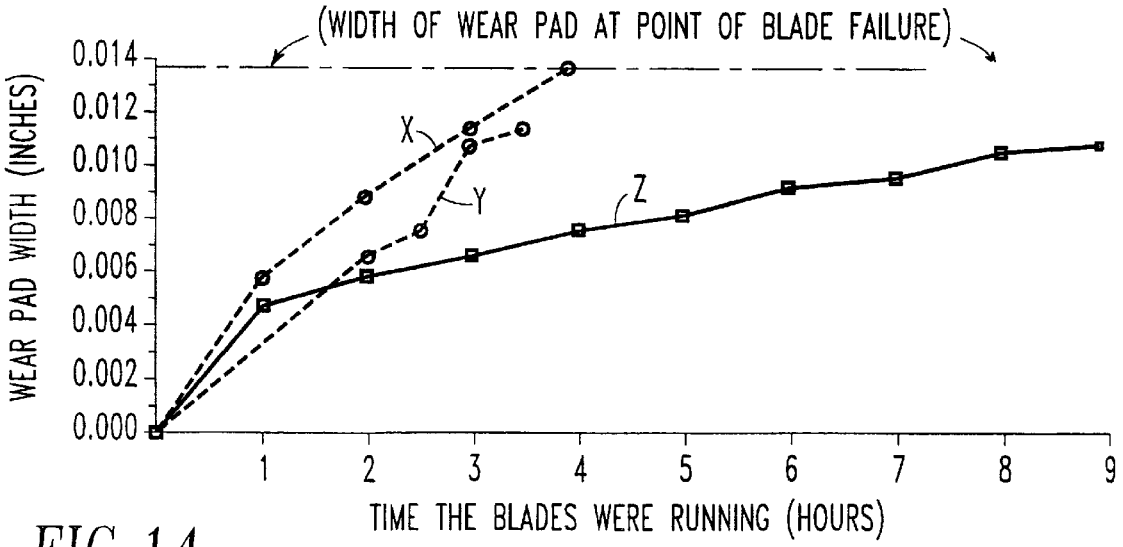
FIG. 14

METHOD OF FORMING A CREPING MEMBER

This application is a Divisional application of Ser. No. 08/912,201, filed Aug. 18, 1997.

FIELD OF THE INVENTION

The present invention relates to a doctor blade for affecting creping of paper in a paper-making machine and more particularly to an extended life doctor blade having an extended wear surface in contact with the rotating drum of the paper-making machine. Further, the present invention is directed to methods of forming such an extended life doctor blade.

BACKGROUND OF THE INVENTION

Doctor blades are commonly used for affecting creping of paper in such paper making machines and for other uses in paper-making machines. In that the doctor blade is normally in contacting relation with the surface of a rotating cylinder, the tip of the doctor blade is subject to wear. As this wear progresses, the doctor blade's effectiveness in forming the creped paper product diminishes. That is, progressive wear of the doctor blade may induce progressive diminution of a particularly important property of the product being made or the material being processed by the apparatus in which the doctor blade is disposed.

For example, doctor blades used for creping paper on a tissue paper making machine precipitate progressively greater loss of machine direction tensile strength of the paper as doctor blade wear progresses. This is particularly true in installations where the impact angle progressively changes as wear occurs due to the way the doctor blade is mounted. Commonly, in such machines, creping blades are replaced with new or newly sharpened blades after a product property of particular importance has been reduced to a predetermined minimum acceptable level by doctor blade wear, or after other observed deterioration of the normal doctor blade performance is apparent.

Processes of forming paper towel and tissue products using conventional wet pressed technology utilize such a doctor blade. In this case, the sheet is folded back upon itself thereby breaking many intrafiber bonds with the creping process imparting considerable softness to the fibrous sheet. However, such a creping process suffers from two fundamental drawbacks stemming from the wear inherent in the creping process. The first being that noted above wherein the blade must be replaced at rather frequent intervals as blade wear typically renders conventional blades unusable after a few hours of use. Further, during the operation of the creping process between blade changes, the softness of the creped product immediately after a blade change can vary considerably from the softness of the product made immediately prior to a blade change as blade wear during the intervening time causes the creping geometry to vary leading to both differing degrees of breakage of the intrafiber bonds and to differing configurations of refolding of the sheet back upon itself.

In one effort to reduce the rate of progression of diminution of important product properties due to doctor blade wear is set forth in U.S. Pat. No. 4,919,756. Therein, doctor blade wear is reduced by continually adjusting the impact angle of the doctor blade. That is, as set forth therein, a method and apparatus for continually adjusting the impact angle of the doctor blade to at least partially offset negative ramifications of progressive doctor blade wear are set forth.

For example, as noted hereinabove, in paper-making machines for making creped tissue paper, a negative effect of progressive doctor blade wear is progressive diminution of machine direction tensile strength of the paper. That is, machine direction tensile strength of the paper is inversely related to doctor blade wear, which wear is directly related to operating time. This progressive lessening of the paper's machine direction tensile strength can be at least partially offset or compensated for by adjusting the impact angle of the doctor blade. Accordingly, this approach varies the angle and pressure of the contact of the doctor blade with the rotating drum of the paper-making apparatus while utilizing conventional doctor blades.

Doctor blades, when in a operation, may be either fixed or reciprocally mounted in the creping apparatus. Such blades function satisfactorily for a varying period of time, the duration of which depends upon the material from which the blade is formed, the condition of the roll surface, the speed at which the roll is revolved as well as other factors. Once the blade is worn, it becomes necessary to interrupt production and replace the blade with a new or resharpened blade thereby providing a new creping edge. This interruption while unavoidable, is manifestly economically undesirable and is particularly serious in the case of creping blades, which presently exhibit a short life span. Considerable effort has been dedicated to overcoming the aforementioned problems. In some cases, so called continuous creped blades are used, while in other cases creping is eliminated from the tissue manufacturing process all together by using a rush transfer process. In such a process, the web is transported by a first moving support and transferred to a subsequent support which is moving a slower speed. Both of these processes introduce considerable complexities into the system which offset many of the advantages and by such processes.

Clearly, there is a need for a creping blade which may be utilized in present conventional creping processes wherein the life of the blade itself is considerably extended thereby minimizing the interruptions in the creping process due to the changing of the blades regardless of the particular application of the blade. Further, there is a need for a creping blade which exhibits an extended operational life as compared to conventional creping blades such that a more uniform softness of the creped product is experienced due to the extended life and minimized blade changes.

SUMMARY OF THE INVENTION

A primary object of the present invention is to overcome the aforementioned shortcomings associated with prior art creping blades and creping processes.

A more specific object of the present invention is to provide a creping blade exhibiting an extended working life as compared to that of conventional creping blades regardless of the particular application of the blade.

Yet another object of the present invention is to provide a creping process wherein the creping geometry is stabilized.

A still further object of the present invention is to provide a creping process and creping blade wherein the period between blade changes is extended as compared to conventional creping processes so as to further stabilize the creping geometry.

Yet another object of the present invention is to provide a creping blade having an extended life wherein the width of the land portion of the creping blade is maintained over an extended period of time as the blade wears due to contact with a rotating surface.

Yet another object of the present invention is to provide a creping blade having an extended working life and which is reusable so as to further extend the life of the blade.

These, as well as additional objects of the present invention, are achieved by providing an improved method of creping tissue using an improved creping doctor blade including the steps of forming a nascent web of tissue comprising cellulosic fibers and water, adhering the nascent web to a drying cylinder, providing a thin, flexible, generally planar creping member engageable against the dryer with the creping member having an engagement protrusion formed thereon extending generally transversely to the plane of the creping member and generally radially with respect to the drying cylinder. A thickness of the engagement protrusion being generally uniform and presenting a generally planar land engaging the surface of the drying cylinder and configured such that the width of the land remains substantially uniform as the engagement protrusion is worn away. The method further includes bringing the engagement land of the creping blade into engagement with the surface of the drying cylinder and maintaining substantially uniform pressure against the drying cylinder across the width of the creping member and rotating the drying cylinder to remove tissue adhered to the drying cylinder by way of the creping blade.

More particularly, the creping doctor blade is provided in a holder including a mechanism for adjusting the local creping blade loading across the width of the drying cylinder to produce a substantially uniform creping blade load against the drying cylinder. The blade includes a thin flexible generally planar creping member having an elongated flexible substantially prismatic body having a relieved substantially planar engagement surface adapted to bear against the drying cylinder. A rake face of the creping doctor blade extends generally outwardly relative to the surface of the rotatable drying cylinder when the creping blade engages the cylinder and the length of the substantially planar engagement surface is generally equivalent to the width of the drying cylinder with the width of the substantially planar engagement surface being from about 0.005 inches to about 0.020 inches with the relief face of the blade adjacent to the rotatable drying cylinder having an elongated depression having a depth of at least about 0.005 inches formed therein. Additionally, the substantially planar engagement surface is relieved such that as the blade wears over the majority of the life of the blade, the width of the substantially planar engagement surface remains within the range of about 0.005 inches to about 0.020 inches. While particular examples are referred to hereinabove, it is an object of the present invention to provide a creping blade structure which increases the average life of the blade by two to four times that of conventional blades used in the same process.

These, as well as additional advantages of the present invention will become apparent from the following detailed description of the present invention when read in light of the several figures.

BRIEF DESCRIPTION OF THE DRAWINGS

FIG. 6 is a schematic illustration of a conventional through air drying process.

FIG. 6A is a schematic illustration of a conventional double creping process.

FIG. 7 is a schematic illustration of the method and apparatus for forming the creping blade illustrated in FIG. 2 in accordance with the present invention.

FIG. 8 is a schematic illustration of the method and apparatus for forming the creping blade illustrated in FIG. 3 in accordance with the present invention.

FIG. 13 is a diagrammatic illustration of the wear pattern of the creping blade illustrated in FIG. 10 as compared to that of a conventional creping blade in accordance with the present invention.

FIG. 14 is a graphic illustration of the extended life achieved when utilizing creping blades in accordance with the present invention.

DETAILED DESCRIPTION OF THE INVENTION

Figure 1:
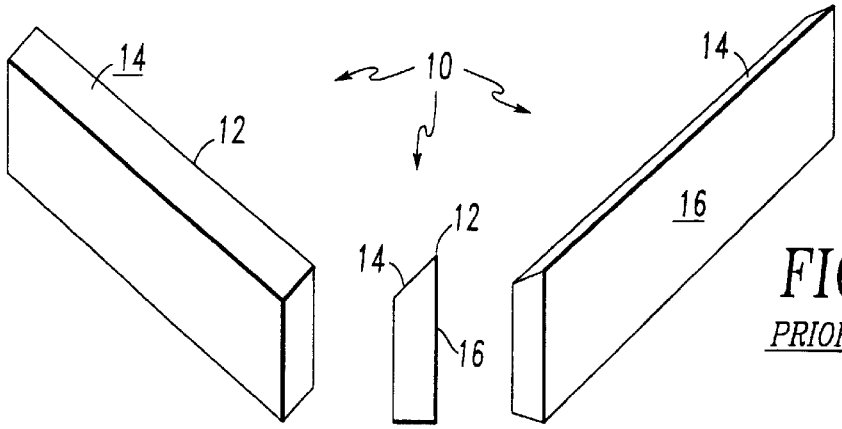
FIG. 1 PRIOR ART
FIG. 1 is a perspective view of a conventional creping blade.

With reference now being made to the several figures, the present invention will now be described in greater detail hereinbelow. It should be noted that like reference numerals will be utilized when referring to like parts throughout the several figures.

Initially, with reference to FIG. 1, this figure illustrates a conventional creping blade 10 which is, in practice, the blank from which creping blades in accordance with the present invention and usable in accordance with the present invention are most conveniently manufactured. The blade 10 includes a contact surface 12 formed between a rake surface 14 and a relief surface 16. As can be seen from FIG. 1, when a new blade is presented for use in conventional creping processes, the contact surface is in the form of a straight line, however, over time, this line contact wears as will be described in greater detail hereinbelow. It is this wear which the present invention addresses and which is of primary importance in forming creping blades and carrying the creping process in accordance with the present invention.

Figure 2:
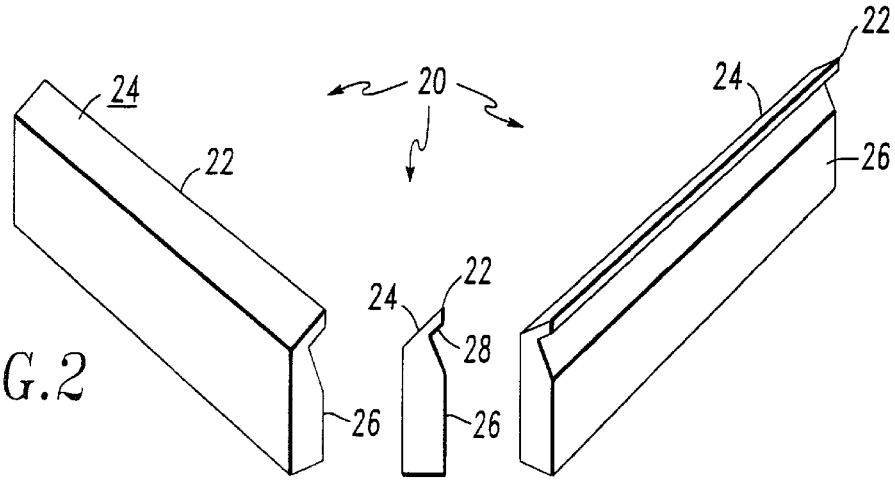
FIG. 2 is a perspective view of a creping blade in accordance with the present invention.

With reference now to FIG. 2, this figure illustrates a creping blade 20 including a contact surface 22 formed between a rake surface and relief surface 26. As can be noted from FIG. 2, the creping blade 20 includes a beaked region 28 which is the essence of the present invention. Further, the significance of the beaked region 28 will be discussed in greater detail hereinbelow.

Figure 3:
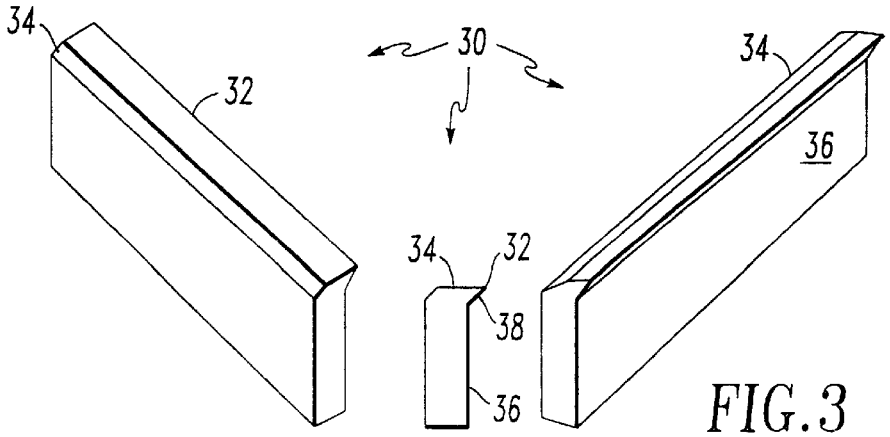
FIG. 3 is a perspective view of a creping blade in accordance with an alternative embodiment of the present invention.

With reference to FIG. 3, this figure illustrates an alternative creping blade 30 formed in accordance with the present invention which includes a contact surface 32 positioned between a rake surface 34 and relief surface 36. While initially the contact surface 32 is a simple line, the contact surface is positioned in a beaked region 38, the significance of which will likewise become apparent from the following detailed description.

Figure 4:
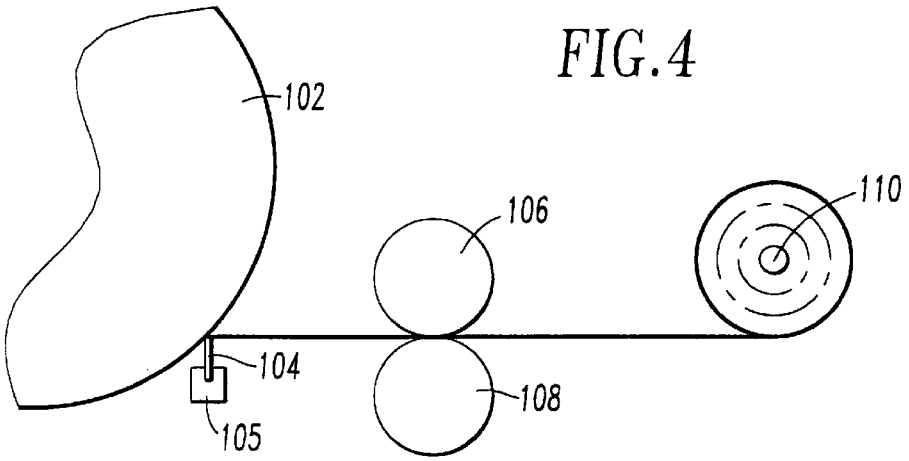
FIG. 4 is a schematic illustration of a conventional dry crepe process.
Figure 5:
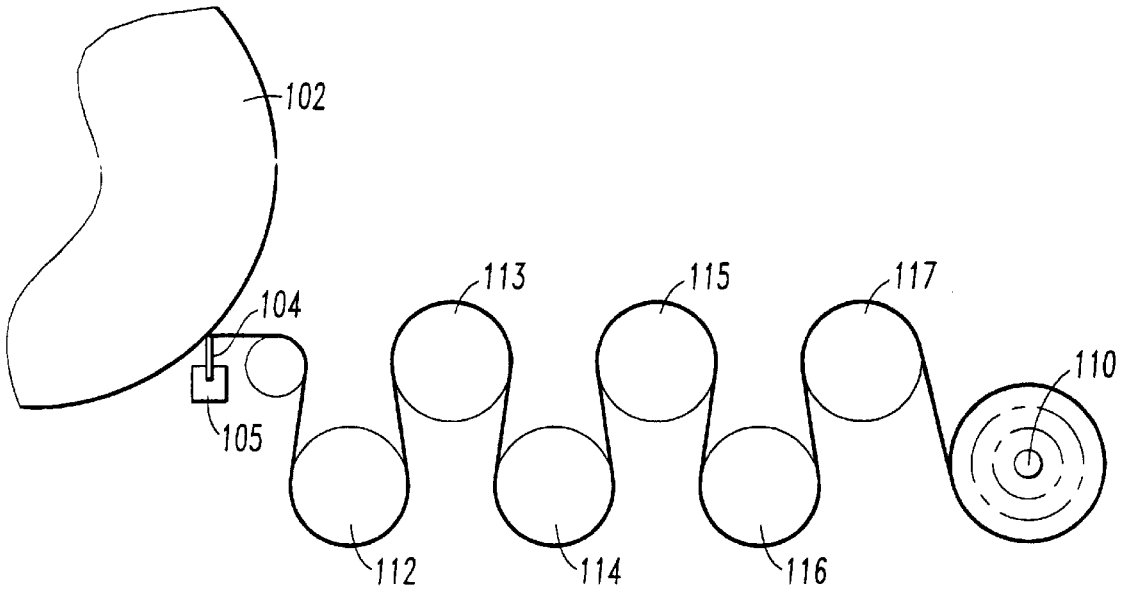
FIG.5 PRIOR ART
FIG. 5 is a schematic illustration of a conventional wet creping process.

With reference now to FIGS. 4–6, the environments in which creping blades formed in accordance with the present invention may be applied are illustrated. The present invention has advantages when used in association with both a dry and wet creping processes as well as through air drying (TAD) processes. The dry creping process illustrated in FIG. 4 is a well-known process wherein the tissue sheet 100 is creped from a drying cylinder which may be a yankee dryer 102 by way of a creping blade 104. The moisture content of the sheet when it contacts the creping blade 104 is usually in the range of 2% to 8%. Optionally, the creped sheet may be calendared by passing it through calendar rolls 106 and 108 which impart smoothness to the sheet while reducing its thickness. After calendaring, the sheet is wound on reel 110. In order to maintain a substantially uniform creping load on the drying cylinder 102, the creping blade is held in a holder 105. This holder may be of the type manufactured by Thermo Electron-Web Systems, Inc., Waltham, Mass.

The wet creping process illustrated in FIG. 5 is carried out in a similar manner wherein the tissue sheet 100 is creped from the yankee dryer 102 utilizing the creping blade 104 held in holder 105. The moisture content of the sheet contacting the creping blade 104 is usually in the range of 15% to 50%. After the creping operation, the drying process is completed by the use of one or more steam heated can dryers 112 through 117. These dryers are used to reduce the moisture content to its desired final level which is usually in the range of 2% to 8% like that of the dry creping process. The dried sheet is then wound on reel 110.

As discussed hcreinabove, yet another process wherein the creping blade in accordance with the present invention may be utilized is that of a through air drying process (TAD). In the TAD process, the wet sheet 100 which has been formed on a forming fabric 120, is transferred to an air drying fabric 122 by way of a vacuum device 124 and is subsequently passed through the through air drying section 126. The through air drying fabric 122 is usually a coarsely woven fabric that allows relatively free passage of air through both the fabric 122 and web 100. While on the fabric 122, the sheet 100 is dried by blowing hot air through the sheet 100 using the through air dryer 126. This operation reduces the sheet's moisture content to a value usually between 10% and 65%. The partially dried sheet 100 is then transferred to the yankee dryer 102 where it is dried to its final desired moisture content and subsequently creped off the yankee dryer in the manner similar to that discussed hereinabove utilizing a creping blade. Such a creping blade is preferably that blade which will be discussed in greater detail hereinbelow.

The present invention may also be utilized in a process for the production of a double or re-creped sheet. In such a process shown in FIG. 6A, a previously creped cellulosic web 103 is adhered to the surface of a yankee dryer 102 wherein the moisture content of the cellulosic web 103 is further reduced while in contact with the yankee dryer 102 and the web is subsequently re-creped from the yankee dryer by the creping blade 104 held in holder 105. The re-creping process includes the application of adhesive to either the substantially dried previously creped web 103 or the yankee dryer 102 itself. The adhesive may be applied in any of a variety of ways such that moisture from the adhesive as well as additional residual moisture in the sheet are removed while the sheet passes over the yankee dryer. The sheet is subsequently again creped from the yankee dryer utilizing a creping blade 104, preferably those blades formed in accordance with the present invention, and subsequently wound onto the reel 110.

Accordingly, as can be seen from the foregoing, there are a number of applications where the use of a creping blade formed in accordance with the present invention would be advantageous. Such advantages will become apparent from the following detailed description of the blade itself.

With reference now to FIGS. 7 and 8, the particular process and apparatus for forming creping blades in accordance with the present invention will be discussed in detail. Particularly, with reference to FIG. 7, a grinding apparatus for forming the creping blade illustrated in FIG. 3 (and FIG. 9) is illustrated. Therein, a creping blade blank 200 similar to the blade illustrated in FIG. 1, is secured in place on a substantially planar working surface 202 with the working surface 202 and the grinding apparatus 204 being linearly moveable with respect to one another. That is, either the working surface 202 may be moveable with respect to the grinding apparatus 204 or the grinding apparatus 204 may move with respect to the working surface 202 in order to form the requisite groove in the creping blank 200.

The groove 28 is formed in the blank 200 in order to form the creping blade 20 referred to in FIG. 2. This groove is accomplished by providing grinding wheels 206 and 208 which may be axially positioned on a single shaft 210 or on separate shafts, if desired. As can be seen from FIG. 7, the grinding wheel 206 forms the rake surface 24 of the creping blade 20 while the grinding wheel 208 forms the groove 28 of the creping blade 20. Each of the grinding wheels 206 and 208 are driven in a conventional manner by way of a drive means 212. The grinding device 204 being illustrated in schematic form in FIG. 7 may take on any configuration so as to form the groove 28 in the blank 200 thus resulting in the creping blade 20. Once formed, the contact surface 22 may be appropriately dressed to properly crepe the cellulosic web from the yankee dryer. The particular configuration of the creping blade 20 will be discussed in greater detail hereinbelow.

With reference now to FIG. 8, an alternative method for forming a creping blade in accordance with the present invention will be discussed in detail. Particularly, the method and apparatus illustrated in FIG. 8 when carried out on a conventional creping blade blank forms the creping blade illustrated in FIG. 3 (and FIG. 10). The schematic illustration of the device in FIG. 8 includes a forming tool 300 formed of steel containing about 5% cobalt and hardened to a hardness $R_c$ of about 65 to 67. While such is referred, less expensive alloys are also suitable as, for example, alloys having a hardness $R_c$ of 63 to 65. Such a tool readily forms a blade in that the blade material is of a hardness of approximately 42 $R_c$.

The forming tool is rotatably supported in a clevis so that the tool can spin about a horizontal axis with the relative position of the tool 300 being fixed with respect to the holding bracket 302. In this regard, care should be taken to ensure that the blade is supported both laterally and vertically as the forces required for forming the creping blade in accordance with the present invention can easily ruin an unsupported blade. With this in mind, either the forming tool 300 is brought into contact with the blade blank 200 or the blade blank 200 is brought into contact with the forming tool 300. Preferably, to begin the forming process, the blade is brought into motion longitudinally with respect to the forming tool 300 and the blade blank 200 is slowly raised by a distance equal to the desired defamation of the blade blank.

That is, prior to forming of the blade blank, the amount of steel desired to be tooled is determined so as to form a beaked region 38 in a desired manner.

Once the forming tool is pressed into the blade to the desired depth, the blade is moved with respect to the forming tool at a moderate speed. This speed being approximately 12 inches per minute. At the end of the travel, the direction of the movement of the blade is reversed and the tool is brought back to its approximate starting position. At this point, the blade is separated away from the forming tool and is subsequently unclamped. This process is carried out over and entire length of the blade or may be repeated in a piece meal fashion until the desired configuration of the blade is achieved. The blade is subsequently finished in a blade dressing holder utilizing a coarse hard hand stone to prepare the blade for contact with a yankee dryer. That is, the stone may be held against the contact surface 12 of the blade at the same angle that the blade makes contact with the yankee dryer when utilized in the creping process. Subsequent to this dressing, the final finish may be applied by hand polishing.

Figure 9:
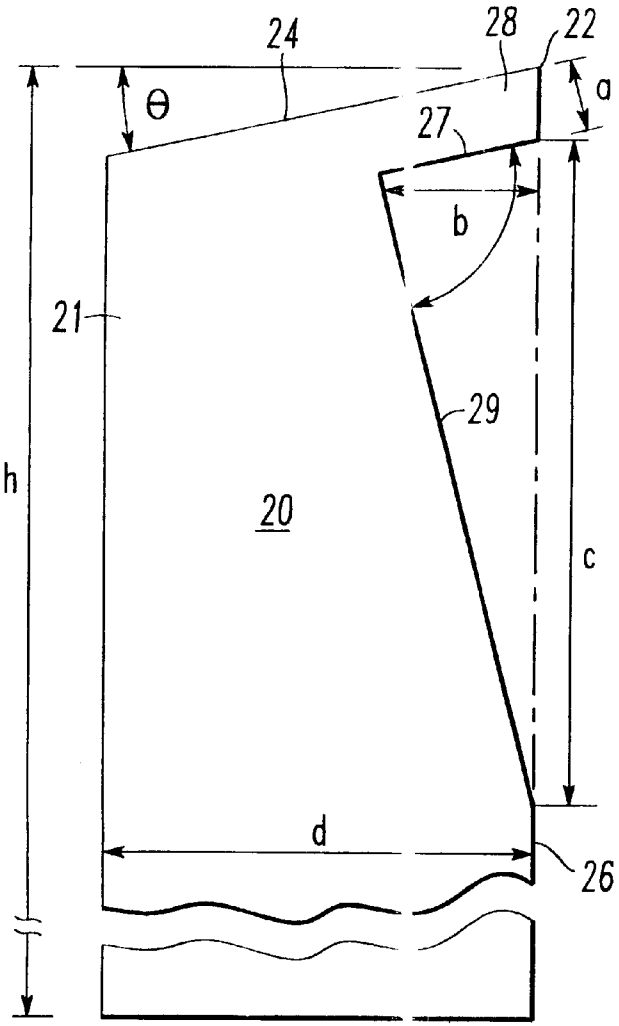
FIG. 9 is an enlarged end view of the creping blade formed utilizing the method and apparatus of FIG. 7 in accordance with the present invention.

The blade form utilizing the grinding apparatus of FIG. 7 is illustrated in FIG. 9. As discussed hereinabove, the blade 20 includes a contact surface 22 extending from a body portion 21 of the blade. The blade includes rake surface 24 which is angled with respect to the horizontal by an angle θ. This angle being in the range of 5° to 20° and preferably approximately 12°. As discussed hereinabove, the blade 20 includes a beaked region 28 which is formed by way of the grinding process discussed hereinabove. This beaked region is of a dimension a and is in a range of 0.005 inches to 0.020 inches. The particular dimension chosen will depend on the width of the wear pad of a conventional blade at replacement. This feature being discussed in greater detail hereinbelow. It is to be noted that the particular dimension of the beaked region 28 is dictated by the strength of the material utilized in forming the blade 20. As is conventional, the blade is pressed into contact with a yankee dryer which exerts a force on the area where the beaked region 28 blends into the body 21. Accordingly, the dimensions must be such that the beaked region 28 does not readily break off from the body portion 21. In the preferred embodiment, the beaked region 28 extends a distance b from the body 21 in a range of 0.005 inches to 60% of the thickness of the blade 20, with this distance being preferably approximately 0.020 inches. Also, the groove formed longitudinally in the blade 20 is of a width c which, in accordance with the preferred embodiment of the present invention is approximately 0.090 inches. The angle formed between surfaces 27 and 29 are at an angle in a range of 75 to 90 degrees with respect to one another. Additionally, as with conventional creping blades, the blade is of a depth d of approximately 0.050 inches and a height h of approximately 4.500 inches. While the aforementioned dimensions are preferred, it should be readily apparent that variations to the foregoing dimensions may be made without departing from the spirit and scope of the present invention.

Figure 10:
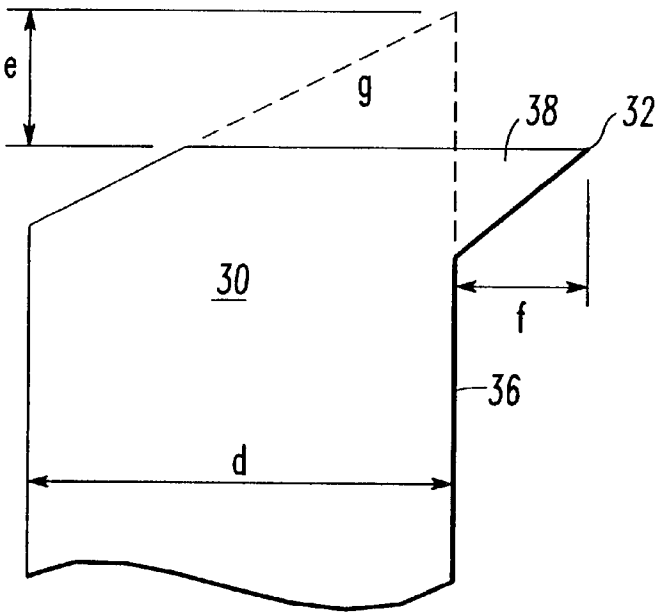
FIG. 10 is an enlarged end view of the creping blade formed utilizing the method and apparatus illustrated in FIG. 8 in accordance with the present invention.

With reference now to FIG. 10, the alternative blade 30 formed in accordance with an alternative embodiment of the present invention, the method of which is illustrated in FIG. 8, will be described in detail.

The blade 30 again is formed from a conventional blade blank having a depth d of approximately 0.05 inches and a height of approximately 4.500 inches. As can be seen from FIG. 10, the height of the blade is reduced by a distance e of approximately 0.014 inches due to the forming of the blade by the forming tool 300 illustrated in FIG. 8. As set forth therein, an upper limit of the conventional blade is press formed so as to form the beak region 38 of the blade 30. The beak region extends outwardly from the blade 30 a distance f of approximately 0.015 inches after being tooled in accordance with the process set forth in FIG. 8. In this regard, the material within the hidden area g is displaced so as to form the beaked region 38 and ultimately the contact surface 32. A particular wear pattern of the contact surface 32 will be discussed in greater detail with respect to FIG. 13 hereinbelow.

Figure 12B:
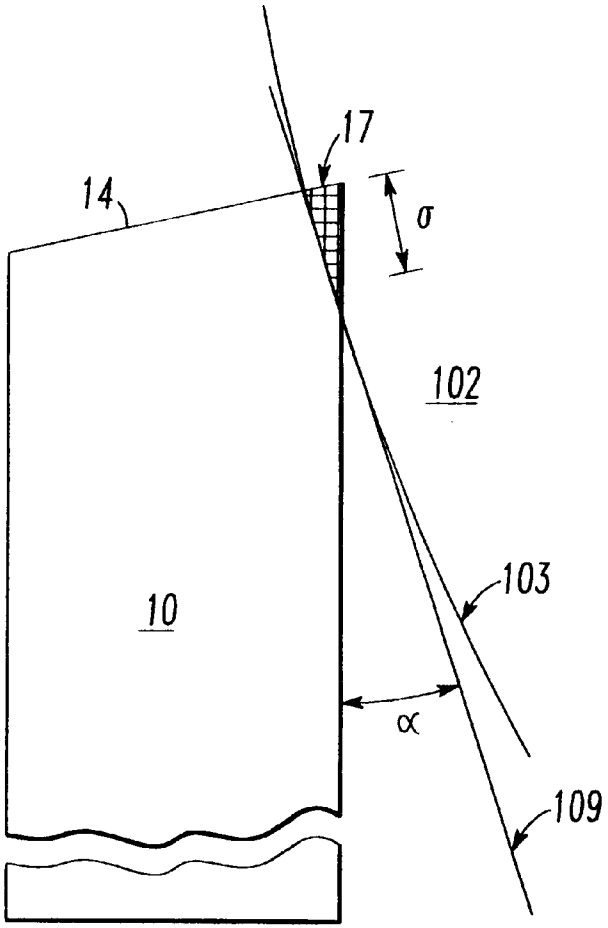
FIG. 12B PRIOR ART
FIGS. 12A and 12B are diagrammatic illustrations of a conventional wear pattern of a conventional creping blade.
Figure 12A:
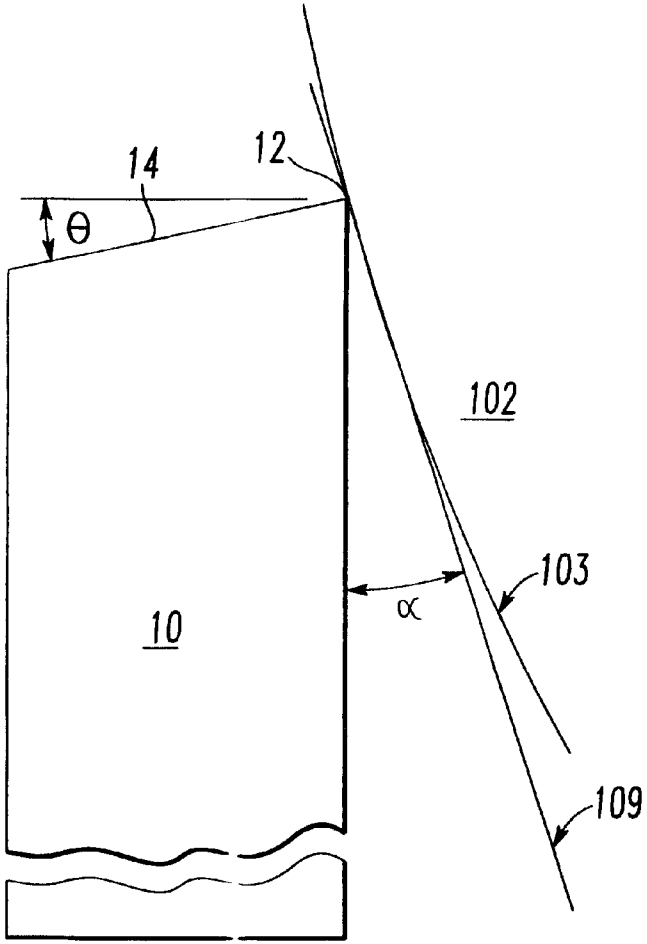
FIG. 12A PRIOR ART

With reference now to FIGS. 12A and 12B, the wear pattern of a conventional creping blade is illustrated in detail. Initially, FIG. 12A illustrates the creping blade 10 in its initial contacting position with a drying drum such as a yankee dryer while FIG. 12B illustrates the conventional creping blade 10 at a time when it is necessary to replace the blade. In a conventional manner, the creping blade 10 includes a rake surface angle θ of approximately 12° and makes initial contact with the yankee dryer surface 103 at a tangential angle β of approximately 18° as indicated by the tangential line 105. During operation of the creping process, the contact surface 12 of the blade begins to and continues to wear until the contact surface is of a dimension j of approximately 0.015 inches. As discussed hereinabove, as the creping blades contact surface wear progresses, the creping blades effectiveness in forming the creped paper product diminishes. That is, progressive wear of the doctor blade may induce progressive diminution of particularly important properties of the product being made. Such properties relate to the machine direction tensile strength of the paper product as well as the bulk and the softness of the product. In this regard, once the wear pattern illustrated in FIG. 12B is reached, the blade must be replaced in a conventional manner. This replacement results in down time of the paper manufacturer machine and subsequently increases manufacturing costs. As can be noted from FIG. 12B, it is only after a short period of time, approximately 3 to 4 hours of operation that such wear pattern is reached. It can be noted that the amount of material removed from the conventional doctor blade 10 requiring replacement is minimal compared to the overall size of the blade.

Figure 11C:
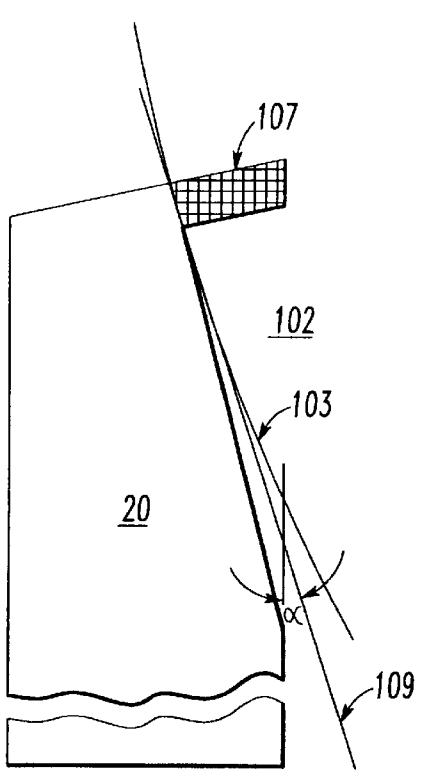
FIGS. 11A–11C are diagrammatic illustrations of the wear pattern of the creping blade illustrated in FIG. 9 in accordance with the present invention.
Figure 11B:
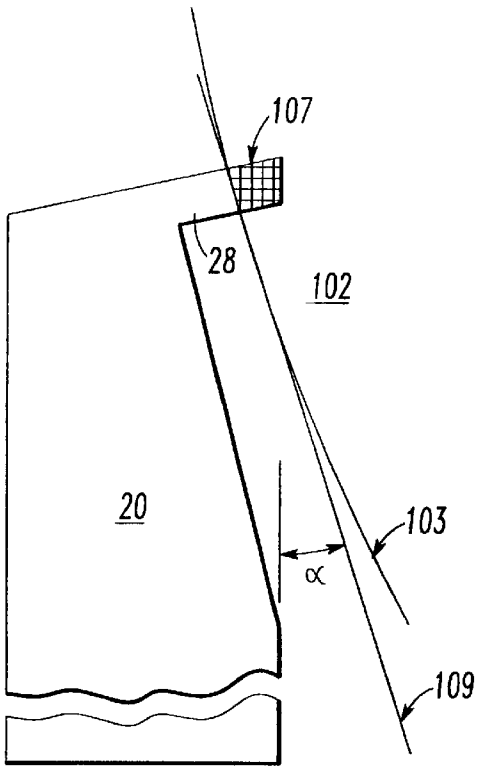
Figure 11A:
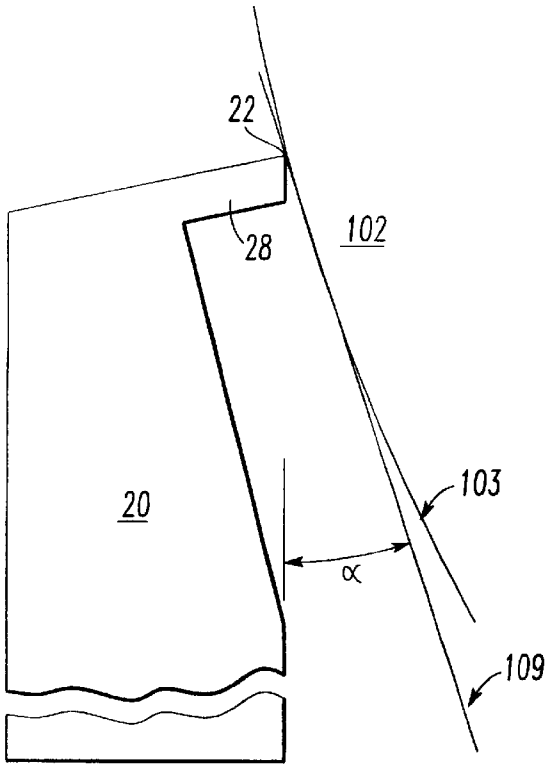

With reference now to FIGS. 11A through 11C, the particular advantages of the present invention are illustrated in detail and readily apparent from such figures. As with the conventional doctor blade, the contact surface 22 of the blade 20 is initially placed in contact with a surface 103 of the yankee dryer 102 at an angle β of approximately 18° with respect to a tangent 105 to the yankee dryer 102. As the blade 20 wears, material illustrated in the cross-hatch region 107 of FIG. b is removed, while the angle with respect to the yankee dryer is maintained. The blade is in continued operation until the wear of the blade reaches the position illustrated in FIG. 11C. As can be seen from FIG. 11C, the worn portion 107 of the blade 20 includes the entire beaked region 28 of the blade. It should be further noted that the cross-hatched region 107 includes a significantly greater portion of material than that of the removed portion 17 of the conventional blade illustrated in FIG. 12B. Accordingly, the blade 20 exhibits a working life which is significantly greater as compared to that of a conventional creping blade. Accordingly, the softness of the creped product formed utilizing a creping blade in accordance with the present invention is more uniform over the entire length of the paper product in that the time interval between replacement of the creping blade is significantly extended. Again, it should be noted that regardless of the particular size and application of the creping blade, a blade formed in accordance with the present invention will exhibit a useful life which is two to four times greater than that of a conventional blade used in the same or similar process.

With reference now to FIG. 13, the wear pattern of the blade 30 formed in accordance with an alternative embodiment of the present invention as compared to that of conventional creping blades is illustrated in detail. As can be seen from FIG. 13, the blade wear of the conventional blade 10 is the same as that illustrated in FIGS. 12A and 12B. As compared to the blade wear of the blade 30, it is noted that after the useful life of the conventional creping blade 10 has expired after approximately 4 hours, while a significant portion of the beaked region 38 of the doctor blade 30 remains. In this regard, the life of the blade 30 when used in conventional creping processes is significantly extended as is apparent from the graphic illustration set forth in FIG. 14. As illustrated in FIG. 14, conventional blades X and Y reach the maximum wear pad width after approximately 4 hours while the wear pattern Z of the wear pad of blade 30 formed in accordance with the present invention exhibits a life significantly longer than that of a conventional blade.

It should be noted that the particular dimension of the extended life creping blade is dictated by the wear pad dimension of a conventional creping blade used in the same or similar process and apparatus. For example, if a conventional blade utilized in a given process is replaced when the wear pad dimension is 0.020 inches, for optimal life of the extended life blade and to provide a blade which will achieve the requisite product properties, a beaked blade formed in accordance with the present invention would have a 0.020 inch thick beak. Similarly, if a conventional blade utilized in a given process is replaced when the wear pad dimension is 0.005 inches, the beaked blade formed in accordance with the present invention would have a 0.005 inch thick beak. If the beak thickness chosen for a given application is too thick, i.e. a 0.020 inch thick beak used in a process where the blade is replaced when at a wear pad thickness of 0.005 inches is reached, the full benefit of the beak blade will not be realized. Further, the requisite properties of the creped product will not be realized. Likewise, if the conventional blade at replacement has a 0.020 inch wear pad, and a beaked blade having a 0.005 inch beak is used, the beaked blade will wear prematurely and not achieve the advantages intended by the present invention.

Accordingly, as can be seen from the foregoing discussion, creping blades formed in accordance with the present invention as illustrated in either FIG. 2 or 3 exhibit an extended working life as compared to that of conventional blades so as to ensure creping geometry stabilization. Such is achieved by providing a creping blade for use in conventional creping processes of the appropriate dimension such that the period between blade changes is extended as compared to conventional creping processes. Such an extended life wherein the width of the land of the creping blade is maintained over an extended period of time as the blade wears due to contact with the rotating surface results in a blade which needs to be replaced at significantly less frequent intervals. Accordingly, utilizing creping blades in accordance with the present invention results in a more uniform paper product while reducing manufacturing cost in that the amount of down time during the manufacturing process is significantly reduced and the frequency of blade sharpening is reduced.

While the present invention has been described with reference to a preferred embodiment, it should be appreciated by those skilled in the art that the invention may be practiced otherwise than is specifically described herein without departing from the spirit and scope of the invention. It is, therefore, to be understood that the spirit and scope of the invention be limited only by the appended claims.

What is claimed is:

1. A method of forming a creping member for engagement with a surface of a drying cylinder comprising:

positioning a creping blank to be formed in a holding means for positioning said creping blank relative to a forming tool; and forming an engagement protrusion extending generally transversely to a planar surface of the creping member and generally radially with respect to the drying cylinder by contacting said planar surface of said creping member with the forming tool, and forming an elongated depression along a length of said planar surface wherein, a thickness of the engagement protrusion is generally uniform and presents a generally planar engagement surface.

2. The method as defined in claim 1, wherein the width of a substantially planar engagement surface is substantially equal to a wear pad width at replacement.

3. The method as defined in claim 1, wherein the width of the substantially planar engagement surface is in a range from about 0.005 inches to about 0.020 inches.

4. The method as defined in claim 1, wherein said elongated depression has a depth of at least about 0.005 inches.

5. The method as defined in claim 4, wherein the step of forming said elongated depression includes removing a portion of said creping blank.

6. The method as defined in claim 5, wherein the removal of said portion of said creping blank includes grinding said creping blank.

7. The method as defined in claim 1, wherein a width of the generally planar engagement surface remains within a range of about 0.005 inches to about 0.020 inches during use of the creping member.

8. The method as defined in claim 1, wherein the step of forming said engagement protrusion includes deforming said creping blank.

9. A method of forming a creping member for engagement with a surface of a drying cylinder comprising;

positioning a creping blank to be formed in a holding means for positioning said creping blank relative to a forming tool; and deforming an elongated end of said creping blank by subjecting said elongated end to pressure by the forming tool thereby displacing material of the elongated end generally transversely to a planar surface of the creping blank.

10. The method as defined in claim 9, wherein the step of deforming said creping blank includes progressively deforming said creping blank by subjecting said creping blank to multiple passes in contact with said forming tool.

* * * * *